US008893614B2

(12) United States Patent
Gygi et al.

(10) Patent No.: US 8,893,614 B2
(45) Date of Patent: Nov. 25, 2014

(54) DEVICE AND METHOD FOR MAGNETICALLY TRANSFERRING INDICIA TO A COATING COMPOSITION APPLIED TO A SUBSTRATE

(75) Inventors: Matthias Gygi, Schmitten (CH); Alain Würsch, La Tour-de-Peilz (CH); Fabienne Meichtry, Yverdon (CH); Alain Jufer, L'isle (CH)

(73) Assignee: KBA-Notasys SA, Lausanne (CH)

( * ) Notice: Subject to any disclaimer, the term of this patent is extended or adjusted under 35 U.S.C. 154(b) by 1262 days.

(21) Appl. No.: 12/599,353

(22) PCT Filed: May 7, 2008

(86) PCT No.: PCT/IB2008/051784

§ 371 (c)(1), (2), (4) Date: Apr. 7, 2010

(87) PCT Pub. No.: WO2008/139373

PCT Pub. Date: Nov. 20, 2008

(65) Prior Publication Data

US 2011/0290129 A1 Dec. 1, 2011

(30) Foreign Application Priority Data

May 10, 2007 (EP) ..... 07107966

(51) Int. Cl.

| | |
|---|---|
| ***B41M 1/12*** | (2006.01) |
| ***B41M 3/14*** | (2006.01) |
| ***B41M 7/00*** | (2006.01) |
| ***B42D 15/00*** | (2006.01) |

(52) U.S. Cl.

CPC ..... *B41M 7/0045* (2013.01); *B41M 3/14* (2013.01); *B42D 2033/16* (2013.01); *B42D 15/0013* (2013.01); *B41M 7/0036* (2013.01)

USPC ..... 101/129; 101/150

(58) Field of Classification Search

USPC ..... 101/129, 150

See application file for complete search history.

(56) References Cited

U.S. PATENT DOCUMENTS

| | | | | |
|---|---|---|---|---|
| 4,186,944 | A * | 2/1980 | Pearce | 283/82 |
| 4,838,648 | A | 6/1989 | Phillips et al. | |

(Continued)

FOREIGN PATENT DOCUMENTS

| | | | |
|---|---|---|---|
| EP | 0 686 675 | A1 | 12/1995 |
| EP | 0 723 864 | A1 | 7/1996 |

(Continued)

OTHER PUBLICATIONS

Specifications Sheet—Plastoferrite materials, Maurer Magnetic AG, Jan. 2006, pp. 15-1 thru 15-8.

(Continued)

*Primary Examiner* — David Banh

(74) *Attorney, Agent, or Firm* — Seager, Tufte & Wickhem LLC

(57) ABSTRACT

There is described a device and method for magnetically transferring indicia to a coating composition, such as an ink or varnish, applied to at least a part of the surface of a substrate, the coating composition comprising at least one type of magnetic or magnetizable particles. The device comprises a body subjected to a magnetic field generated by appropriate electromagnetic means, which body carries determined indicia in the form of engravings on a surface of the body, which engravings influence orientation of field lines of the magnetic field. The body comprises at least one layer of material of high magnetic permeability in which the engravings are formed. In unengraved regions of the layer of material of high magnetic permeability, the field lines of the magnetic field extend substantially parallel to the surface of the body inside said layer of material of high magnetic permeability.

25 Claims, 21 Drawing Sheets

(56) References Cited

U.S. PATENT DOCUMENTS

| | | | | |
|---|---|---|---|---|
| 5,192,611 | A * | 3/1993 | Tomiyama et al. | 428/354 |
| 5,671,671 | A | 9/1997 | Wyssmann et al. | |
| 5,839,366 | A | 11/1998 | Schaede | |
| 5,960,716 | A | 10/1999 | Schaede | |
| 6,109,172 | A | 8/2000 | Wyssmann | |
| 6,152,035 | A * | 11/2000 | Scholtz et al. | 101/389.1 |
| 6,818,299 | B2 | 11/2004 | Phillips et al. | |
| 6,838,166 | B2 | 1/2005 | Phillips et al. | |
| 6,875,522 | B2 | 4/2005 | Seto et al. | |
| 7,047,883 | B2 | 5/2006 | Raksha et al. | |
| 7,258,900 | B2 | 8/2007 | Raksha et al. | |
| 7,287,467 | B2 | 10/2007 | Stöhr | |
| 7,458,319 | B2 | 12/2008 | Stöhr | |
| 2002/0160194 | A1 | 10/2002 | Phillips et al. | |
| 2003/0143400 | A1 | 7/2003 | Phillips et al. | |
| 2003/0170471 | A1 | 9/2003 | Seto et al. | |
| 2004/0009309 | A1 * | 1/2004 | Raksha et al. | 427/598 |
| 2004/0028905 | A1 | 2/2004 | Phillips et al. | |
| 2004/0051297 | A1 | 3/2004 | Raksha et al. | |
| 2004/0144269 | A1 * | 7/2004 | Severino | 101/217 |
| 2005/0160925 | A1 | 7/2005 | Stöhr | |
| 2006/0081151 | A1 | 4/2006 | Raksha et al. | |
| 2006/0150854 | A1 * | 7/2006 | Benninger et al. | 101/489 |
| 2006/0198998 | A1 * | 9/2006 | Raksha et al. | 428/323 |
| 2006/0219107 | A1 * | 10/2006 | Gygi | 101/129 |
| 2007/0115337 | A1 | 5/2007 | Raksha et al. | |
| 2007/0172261 | A1 * | 7/2007 | Raksha et al. | 399/266 |
| 2007/0193462 | A1 | 8/2007 | Schaede | |
| 2007/0261575 | A1 | 11/2007 | Stöhr | |
| 2008/0213516 | A1 | 9/2008 | Wild | |
| 2008/0271631 | A1 | 11/2008 | Hoier et al. | |
| 2009/0230670 | A1 | 9/2009 | Schmid et al. | |
| 2010/0040845 | A1 * | 2/2010 | Schmid et al. | 428/207 |
| 2010/0170408 | A1 * | 7/2010 | Gygi et al. | 101/116 |
| 2010/0242753 | A1 * | 9/2010 | Gygi | 101/116 |

FOREIGN PATENT DOCUMENTS

| | | | |
|---|---|---|---|
| EP | 0 769 376 | A1 | 4/1997 |
| EP | 0 686 675 | B1 | 2/1998 |
| EP | 1 493 590 | A1 | 1/2005 |
| EP | 1 650 042 | A1 | 4/2006 |
| EP | 1 787 728 | A1 | 5/2007 |
| EP | 1 961 559 | A1 | 8/2008 |
| WO | 97/29912 | A1 | 8/1997 |
| WO | 97/34767 | A1 | 9/1997 |
| WO | 02/073250 | A2 | 9/2002 |
| WO | 03/000801 | A2 | 1/2003 |
| WO | 03/093013 | A2 | 11/2003 |
| WO | 2004/007095 | A2 | 1/2004 |
| WO | 2004/007096 | A2 | 1/2004 |
| WO | 2004/096545 | A2 | 11/2004 |
| WO | 2005/000585 | A1 | 1/2005 |
| WO | 2005/002866 | A1 | 1/2005 |
| WO | 2005/095109 | A1 | 10/2005 |
| WO | 2005/102699 | A1 | 11/2005 |
| WO | 2006/061301 | A1 | 6/2006 |
| WO | 2006/114289 | A1 | 11/2006 |
| WO | 2008/102303 | A2 | 8/2008 |

OTHER PUBLICATIONS

Specifications Sheet—Samarium Cobalt materials, Maurer Magnetic AG, Nov. 2004, pp. 12-1 thru 12-2.

* cited by examiner

DEVICE AND METHOD FOR MAGNETICALLY TRANSFERRING INDICIA TO A COATING COMPOSITION APPLIED TO A SUBSTRATE

TECHNICAL FIELD

The present invention generally relates to a device and method for magnetically transferring indicia to a coating composition, such as an ink or varnish, applied to at least a part of the surface of a substrate, which coating composition comprises magnetic or magnetizable particles. The present invention also relates to the use of such a device and the application of such a method to produce printed documents, such as banknotes or like valuable and security documents.

BACKGROUND OF THE INVENTION

Methods and devices for magnetically transferring indicia to a wet coating composition are already known as such in the art, for instance from International applications Nos. WO 2004/007095, WO 2004/007096, WO 2005/000585, WO 2005/002866 and European patent application No. EP 1 650 042.

According to these methods, a layer of coating composition, such as an ink or varnish, is first applied to at least a part of the surface of a substrate, which coating composition comprises at least one type of magnetic or magnetizable particles. While the layer of coating composition is still wet, the layer is exposed to a determined magnetic field generated at a surface of a magnetic-field-generating device, thereby orienting the magnetic or magnetizable particles along field lines of the magnetic field. The layer of coating composition is then dried or cured, thereby fixing the orientation of the magnetic or magnetizable particles.

European patent application No. EP 1 787 728 (which application was published only after the priority date of the present application) discloses a magnetic plate for printing of optical effects, which plate comprises a magnetizable composite material that is selectively magnetized so that one or more first regions across the surface of the plate provide a first magnetic field having a predetermined direction. These first regions form a logo, indicia or image of an object. Magnetic material in one or more other second regions surrounding the first region are either unmagnetized or magnetized differently from the one or more first regions so as to provide a contrast in magnetic field.

Magnetic or magnetizable particles (also designated as "magnetic flakes"), which have the particularity that they can be oriented or aligned by an appropriately-applied magnetic field, are discussed in particular in U.S. Pat. No. 4,838,648, European patent application EP 0 686 675, and International applications WO 02/073250, WO 03/000801, WO 2004/007095, WO 2004/007096 and WO 2005/002866.

Such particles or flakes are in particular used as optically-variable pigments in so-called optically-variable inks, or OVI®'s (OVI® is a registered trademark of SICPA Holding SA, Switzerland) to produce high-level security patterns, especially for banknotes.

The most convenient method to apply the above magnetic flakes is by silk-screen printing as discussed in the above-mentioned International application WO 2005/000585. This is mainly due to the fact that the flakes have a relatively important size which restricts the choice of available printing processes for applying inks or varnishes containing such flakes. In particular, one has to ensure that the flakes are not destroyed or damaged during the printing process, and silk-screen printing constitutes the most convenient printing process to achieve this goal. Furthermore, silk-screen printing has the advantage that the inks or varnishes used in such a process exhibit a relatively low viscosity which favours proper orientation of the magnetic flakes.

Nevertheless, other printing processes could be envisaged to apply coating compositions containing magnetic flakes, such as flexographic printing or gravure printing. In European patent application EP 1 650 042, it is even proposed to apply such magnetic flakes in an intaglio printing process, whereby the paste-like intaglio ink containing the magnetic pigments is heated to decrease the viscosity of the ink and thereby allow the flakes to be oriented more easily with a magnetic or electric field. This can be performed in a conventional intaglio printing press, since the plate cylinder of such presses is commonly brought to an operating temperature of approximately 60 to 80° C. during printing operations.

Orientation of the magnetic flakes contained in the wet coating composition is carried out by applying an adequate magnetic field to the freshly-applied layer of coating composition. By appropriately shaping the field lines of the magnetic field, the magnetic flakes can be aligned in any desired pattern producing a corresponding optically-variable effect which is very difficult, if not impossible to counterfeit. An adequate solution for orienting the magnetic flakes, as discussed in International application WO 2005/000585 consists in bringing sheets carrying layers of wet coating composition in contact with a rotating cylinder carrying a plurality of magnetic-field-generating devices.

International application WO 2005/002866, which is incorporated herein by reference, discloses a particular type of magnetic-field-generating device comprising a body, such as a flat plate or a cylindrically curved plate, made of a permanent magnetic material which is permanently magnetized in a direction substantially perpendicular to a surface of the body. The said surface of the body furthermore carries indicia in the form of engravings causing perturbations of its magnetic field.

FIG. 1 is a schematic cross-sectional view of a magnetic field simulation taken from the above-mentioned International application which illustrates an example of a vertically magnetized permanent magnetic plate, designated by numerical reference 1, comprising a rectangular engraving 2. In this example, the engraved plate 1 is made of Plastoferrite (such as the Plastoferrite model M100.8 sold by Maurer Magnetic AG, CH-8627 Grüningen, http://www.maurermagnetic.ch) magnetized in a direction perpendicular to the surface of the plate 1.

As illustrated in FIG. 1, as the permanent magnetic body 1 is vertically magnetized, the field lines of the magnetic field are mostly vertical in the region of the surface of the body, except in the region of the vertical walls of the engraving 2. This implies that most of the magnetic pigments contained in the wet composition are aligned in a vertical manner, perpendicularly to the surface of the substrate. In other words, considering the fact that the pigments are mostly reflective when they are aligned substantially horizontally, the resulting pattern induced in the coating composition by means of the device of FIG. 1 is mostly not reflective, when seen and illuminated perpendicularly to the surface of the substrate.

FIGS. 2*a* to 2*c* are greyscale photographs, taken along three different viewing angles, of a magnetically-induced pattern representing the value "50" within an oval shape which was produced by means of a device according to the principle of International application WO 2005/002866 illustrated in FIG. 1. More precisely, the pattern was produced using a body having engravings representing the value "50" within an engraved oval shape.

The layer of coating composition was applied with a silk-screen printing process on top of a black offset background using an OVI® silk-screen ink comprising gold-to-green optically variable magnetic pigment corresponding to the 7-layer pigment design disclosed in WO 02/73250. The purpose of the black (or dark) offset background is to increase the contrast in the induced pattern by making the reflective parts of the pattern (i.e. the portions where the pigments are oriented substantially horizontally with respect to the surface of the substrate) stand out as compared to the less reflective parts of the pattern (i.e. the portions where the pigments are oriented substantially vertically with respect to the surface of the substrate, thereby revealing the underlying background).

As already mentioned hereinabove, most part of the induced pattern produced according to the known method disclosed in International application WO 2005/002866 is relatively dark, i.e. the pigments are mostly aligned vertically, thereby making the dark offset background visible through the layer of coating composition. As can be seen from the photographs of FIGS. 2*a* to 2*c*, the most reflective portions of the magnetically-induced pattern correspond to the position of the walls of the engravings. Looking at the pattern, one basically has the impression that the oval shape and the value "50" stand out in relief above the background as illustrated in FIGS. 2*a* to 2*c*.

The patterns that can be produced according to the known method disclosed in International application WO 2005/002866 discussed above are already quite an improvement as compared to the patterns that could previously be produced. A need has nevertheless arisen for an improved approach which would enable to produce different patterns, albeit with comparable means, especially patterns exhibiting a comparatively lighter, more reflective optical effect.

A distinct approach is proposed in International application No. WO 2006/114289 which discloses a method for creating color effect images on a carrier substrate. According to this method, a latent magnetic image comprising magnetic pixels and non-magnetic pixels is created on a magnetizable printing form. A carrier substrate provided with a decorative layer containing non-spherical, preferably needle shaped or lamellar magnetic color effect pigments is guided past the magnetizable printing form such that the orientation of color effect pigments of the decorative layer relative to the carrier substrate changes with the aid of the images of the field lines created by the magnetic pixels of the magnetizable printing form. The color pigments are ultimately fixed in the decorative layer with the orientation thereof modified by the magnetizable printing form.

According to WO 2006/114289, the magnetizable printing form comprises a soft magnetic band and electromagnetic printing heads are used to locally change the magnetic coercivity of the soft magnetic band to form the desired magnetic pixels. A "soft magnetic" material is commonly understood as designating a magnetizable material which has the ability to lose its memory of previous magnetizations, as opposed to "hard" or "permanent" magnetic material which stay magnetized for a long time. According to WO 2006/114289, each magnetic pixels thus acts as an elementary magnet locally affecting the orientation of the field lines of the magnetic field.

This approach is fundamentally different from that of WO 2005/002866 in that it is not based on the use of an engraved body for influencing the orientation of the field lines of a magnetic field generated by separate electromagnetic means. Moreover, since a soft magnetic material is used according to WO 2006/114289, there is a high risk that the magnetic configuration of the magnetizable body may become lost or be affected by external magnetic fields. The solutions of WO 2005/002866 and WO 2006/114289 may not therefore be combined together. The solution of WO 2006/114289 is furthermore less robust than that of WO 2005/002866 and is thus not suited for use in a conventional production environment such as that of a printing plant and/or for implementation thereof on a printing press.

SUMMARY OF THE INVENTION

An aim of the invention is therefore to improve the known devices and methods for magnetically transferring indicia to a coating composition comprising magnetic or magnetizable particles A further aim of the present invention is to provide a device for magnetically transferring indicia to a coating composition comprising magnetic or magnetizable particles that is relatively easy and cheap to produce.

Still another aim of the present invention is to provide a solution that increases the level of security of the resulting magnetically-induced pattern and makes it even more difficult to counterfeit.

Yet another aim of the present invention is to provide a solution that is robust and is suited for use in a conventional production environment such as that of a printing plant and/or for implementation thereof on a printing press.

These aims are achieved thanks to the solution defined in the claims.

According to the invention, there is accordingly proposed a device for magnetically transferring indicia to a layer of coating composition, such as an ink or varnish, applied to at least a part of the surface of a substrate, the coating composition comprising at least one type of magnetic or magnetizable particles. The device comprises a body subjected to a magnetic field, which body carries determined indicia in the form of engravings on a surface of the body, which engravings influence the orientation of field lines of the magnetic field. The body further comprises at least one layer of material of high magnetic permeability in which the engravings are formed. The material of high magnetic permeability is understood as being a material having a magnetic permeability substantially greater than the magnetic permeability of vacuum $\mu_0$ ($\mu_0=4\pi\ 10^{-1}\ \mu N/A^2$) and which has the ability to concentrate the field lines of the magnetic field. In the unengraved regions of the layer of material of high magnetic permeability, the field lines of the magnetic field extend substantially parallel to the surface of the body inside the layer of material of high magnetic permeability. Due to the presence of the engravings on the body, the field lines of the magnetic field are forced along different routes and orientations outside the layer of material of high magnetic permeability, the field lines of the magnetic field extending, in the regions directly above the engravings, substantially horizontally above the surface of the body where the layer of coating composition applied to the substrate is to be located.

Thanks to this solution, a comparatively more reflective pattern can be created, which pattern moreover exhibits a radically different optical-effect than that of the prior art.

According to a preferred embodiment, the body further comprises a base plate of material of low magnetic permeability supporting the layer of material of high magnetic permeability. The material of low magnetic permeability is understood as being a material having a magnetic permeability substantially equal to the magnetic permeability of vacuum $\mu_0$ and which does not substantially affect the field lines of the magnetic field and behaves substantially like free space or vacuum. In this context, the layer of material of high magnetic permeability can advantageously be deposited on the base plate by galvanization. Still in the context of this embodiment, the magnetic permeability of the base plate is preferably in the range of 1.25 to 1.26 $\mu N/A^2$. A preferred material for the base plate is a non-ferromagnetic material such as copper, aluminium or alloys thereof.

The effect can be maximized when the engravings in the layer of material of high magnetic permeability extend through the whole thickness of the layer.

According to an advantageous embodiment, the magnetic permeability of the layer of material of high magnetic permeability is selected to be greater than 100 $\mu N/A^2$ (@ 0.002 T), preferably between 100 to 1000 $\mu N/A^2$ (@ 0.002 T). In this context, a suitable material is a ferromagnetic material such as iron, nickel, cobalt or alloys thereof.

The thickness of the layer of material of high magnetic permeability is preferably selected so as to be greater or equal to 50 microns, even more preferably between 50 to 500 microns.

As regards the engravings in the layer of material of high magnetic permeability, those preferably comprise engraved rectilinear or curvilinear patterns having a line width and/or a line spacing of 1 millimeter or more.

The magnetic field can advantageously be generated by means of at least one permanent magnet or electromagnet, preferably two.

The field lines of the magnetic field, seen perpendicular to the surface of the body 20, can extend along substantially one main direction. In this context, it is advantageous to change the main direction of the field lines of the magnetic field during exposure of the layer of coating composition. This change is preferably carried out by rotating the main direction of the magnetic field by 360°.

The device of the present invention can advantageously be shaped as a curved plate adapted for mounting onto a rotatable cylinder body of a printing press or as an individual curved plate element adapted for mounting onto a supporting member disposed on the circumference of a cylindrical body of a printing press.

Also claimed is a method for magnetically transferring indicia onto a substrate, comprising the steps of:

(a) applying a layer of a coating composition, such as an ink or varnish, onto at least a part of the surface of the substrate, the coating composition comprising at least one type of magnetic or magnetizable particles;

(b) while the layer of coating composition is still wet, exposing the layer of coating composition to a determined magnetic field generated at a surface of a device according to the invention, thereby orienting the magnetic or magnetizable particles along field lines of the magnetic field; and (c) drying or curing the layer of coating composition, thereby fixing the orientation of said magnetic or magnetizable particles.

In the context of this method, the coating composition is preferably applied by printing, even more preferably by silk-screen printing, flexographic printing or gravure printing.

Also claimed is a printed document, in particular a banknote, comprising a substrate with a coating composition applied to a least a part of a surface of the substrate and indicia magnetically-induced in the coating composition according to the above method.

Yet another claimed object is the use of the above device for magnetically inducing transfer of indicia to a wet coating composition, such an ink or varnish, applied to at least a part of the surface of a substrate, which coating composition comprises at least one type of magnetic or magnetizable particles.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The expression "magnetically transferring indicia" (which expression is also used in International application WO 2005/002866) is used in the context of the present invention because indicia is virtually "transferred" from an indicia-bearing body to the wet coating composition comprising the magnetic or magnetizable particles thanks to a determined orientation of the field lines of a magnetic field as this will be explained. In this context, the term "transferring" is to be understood as being equivalent to the term "forming" or "inducing" (which terms can therefore also be used to designate the indicia creation process).

Figure 3:
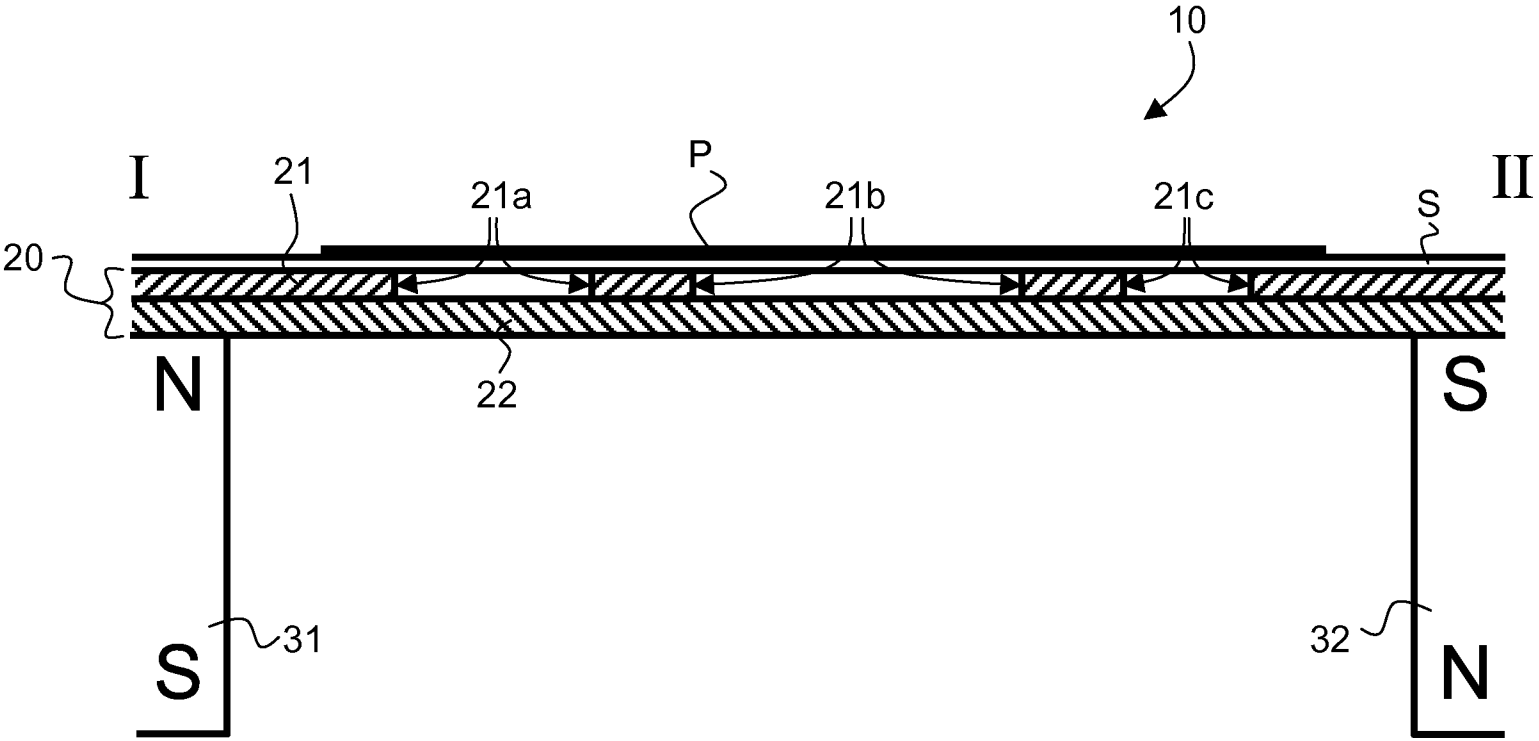
FIG. 3 is a schematic cross-sectional view of a magnetic-field-generating device according to a preferred embodiment of the present invention.

FIG. 3 is a schematic cross-sectional view of a magnetic-field-generating device, designated globally by reference numeral 10, according to a preferred embodiment of the present invention. According to this embodiment, the device 10 includes a body 20 the purpose of which is to influence the orientation of field lines of a magnetic field, as this will be explained hereinafter. According to this preferred embodiment, the body 20 comprises a layer 21 made of material of high magnetic permeability in which engravings 21*a*, 21*b*, 21*c* are formed, and a base plate 22 made of material of low magnetic permeability which supports the layer 21.

Also illustrated in FIG. 3 is a sheet S disposed on top of the surface of the body 20 in contact with the upper surface of layer 21, which sheet S comprises a layer of coating composition P applied on the surface of the sheet S, opposite the surface of layer 21. Coating composition P comprises at least one type of magnetic or magnetizable particles, as discussed hereinabove, that one wishes to orient by means of the magnetic-field-generating device 10.

In the context of the present invention, one will understand that the method for magnetically transferring indicia onto the substrate S comprises the steps of:

(a) applying the layer of coating composition P, such as an ink or varnish onto at least a part of the surface of the substrate S (the coating composition P comprising at least one type of magnetic or magnetizable particles such as those described in WO 02/73250);

(b) while the layer of coating composition P is still wet, exposing the layer of coating composition P to a determined magnetic field generated at a surface of the device 10 according to the present invention, thereby orienting the magnetic or magnetizable particles along field lines of the magnetic field; and (c) drying or curing the layer of coating composition P, thereby fixing the orientation of the magnetic or magnetizable particles.

Within the scope of the present invention, it will be understood that a material of "high magnetic permeability" is a material that has the ability to concentrate the field lines of a magnetic field (i.e. is "magnetically attractable"), while a material of "low magnetic permeability" is a material that does not substantially affect the field lines of a magnetic field and behaves substantially like free space or vacuum. In other words, a material of "low magnetic permeability" will be understood as a material having a magnetic permeability $\mu$ substantially equal to $\mu_0$, where $\mu_0$ is commonly understood to be the magnetic permeability of vacuum and equals the following constant value (1):

$$\mu_0=4\pi\ 10^{-1}\ \mu N/A^2 \quad (1)$$

Preferably, the material of low magnetic permeability is selected to be a material having a magnetic permeability in the range of 1.25 to 1.26 $\mu N/A^2$.

In contrast, a material of "high magnetic permeability" is a material having a magnetic permeability $\mu$ that is substantially greater than $\mu_0$. More precisely, according to the present invention, material of high magnetic permeability will be understood as materials preferably exhibiting a magnetic permeability greater than 100 $\mu N/A^2$ (@ 0.002 T), even more preferably materials exhibiting a magnetic permeability between 100 to 1000 $\mu N/A^2$ (@ 0.002 T). It shall be understood that the magnetic permeability of materials varies with flux density. The above-mentioned values are therefore given considering a flux density of 0.002 T (hence the indication "@ 0.002 T" following the mentioned values).

Among materials of high magnetic permeability suitable for forming layer 21, one in particular knows so-called ferromagnetic materials such as iron, nickel, cobalt or alloys thereof (e.g. steel, permalloy, etc.). Within the scope of the present invention, any material of high magnetic permeability is suitable. Tests have however shown that material exhibiting a magnetic permeability comprised between 100 to 1000 $\mu N/A^2$ (@ 0.002 T) are sufficient, and that materials exhibiting a magnetic permeability higher than 1000 $\mu N/A^2$ (@ 0.002 T), while also suitable, are not necessary.

A particularly suitable material for layer 21 is nickel, which material has a magnetic permeability of approximately 125 $\mu N/A^2$ (@ 0.002 T). This material is convenient as it is commonly used in the banknote industry to produce intaglio printing plates, especially by galvanization, and is thus readily available to the banknote printer. This material is furthermore very easy to engrave (for instance mechanically by means of a rotating chisel or by means of gaseous or liquid jets of abrasives, by chemical etching, or even by laser ablation using $CO_2$, Nd—YAG or excimer lasers).

Among materials of low magnetic permeability suitable for forming base plate 22, one in particular knows so-called non-ferromagnetic materials such as copper, aluminium or alloys thereof. Within the scope of the present invention, any material of low magnetic permeability is suitable. Glass or plastic could for instance be used as material for the base plate 22.

According to an alternative of the invention, one could even do without the base plate 22, for instance by making the layer 21 self-supporting. The base plate 22 of material of low magnetic permeability is therefore not essential but preferred.

A particularly suitable material for base plate 22 is copper, which material has a magnetic permeability of approximately 1.2566290 $\mu N/A^2$. This material is also convenient as it is again commonly used in the banknote industry and is thus readily available to the banknote printer. A perfectly suitable alternative is aluminium which exhibits a magnetic permeability of approximately 1.2566650 $\mu N/A^2$.

Successful tests have been carried out by the Applicant using a copper base plate 22 and a nickel layer 21 deposited on the copper base plate 22 by galvanization. The copper base plate 22 was approximately 0.5 mm thick and the nickel layer 21 was deposited by galvanization with layer thicknesses ranging from 50 to 500 microns.

Turning back to the embodiment illustrated in FIG. 3, the magnetic field is generated in this example by a pair of permanent magnets 31, 32 (such as samarium-cobalt—SmCo—magnets as supplied by Maurer Magnetic AG) disposed at two ends I, II of the device 10. As illustrated, the permanent magnet 31 is disposed with its north magnetic pole oriented upwards, while the permanent magnet 32 is disposed with its north magnetic pole oriented downwards. The resulting magnetic field is such that field lines of the magnetic field will extend from the north magnetic pole of permanent magnet 31 at end I through the base plate 22, into layer 21, then substantially horizontally through, above and below the layer 21, from end I to end II, back through the base plate 22 and to the south magnetic pole of permanent magnet 32. The remainder of the magnetic circuit is closed through connection of the magnetic field lines at the lower part of the device, via the north magnetic pole of permanent magnet 32 and the south magnetic pole of permanent magnet 31. It will be appreciated that the same magnetic field configuration could alternatively be generated using electromagnets instead of the permanent magnets 31, 32.

Figure 4:
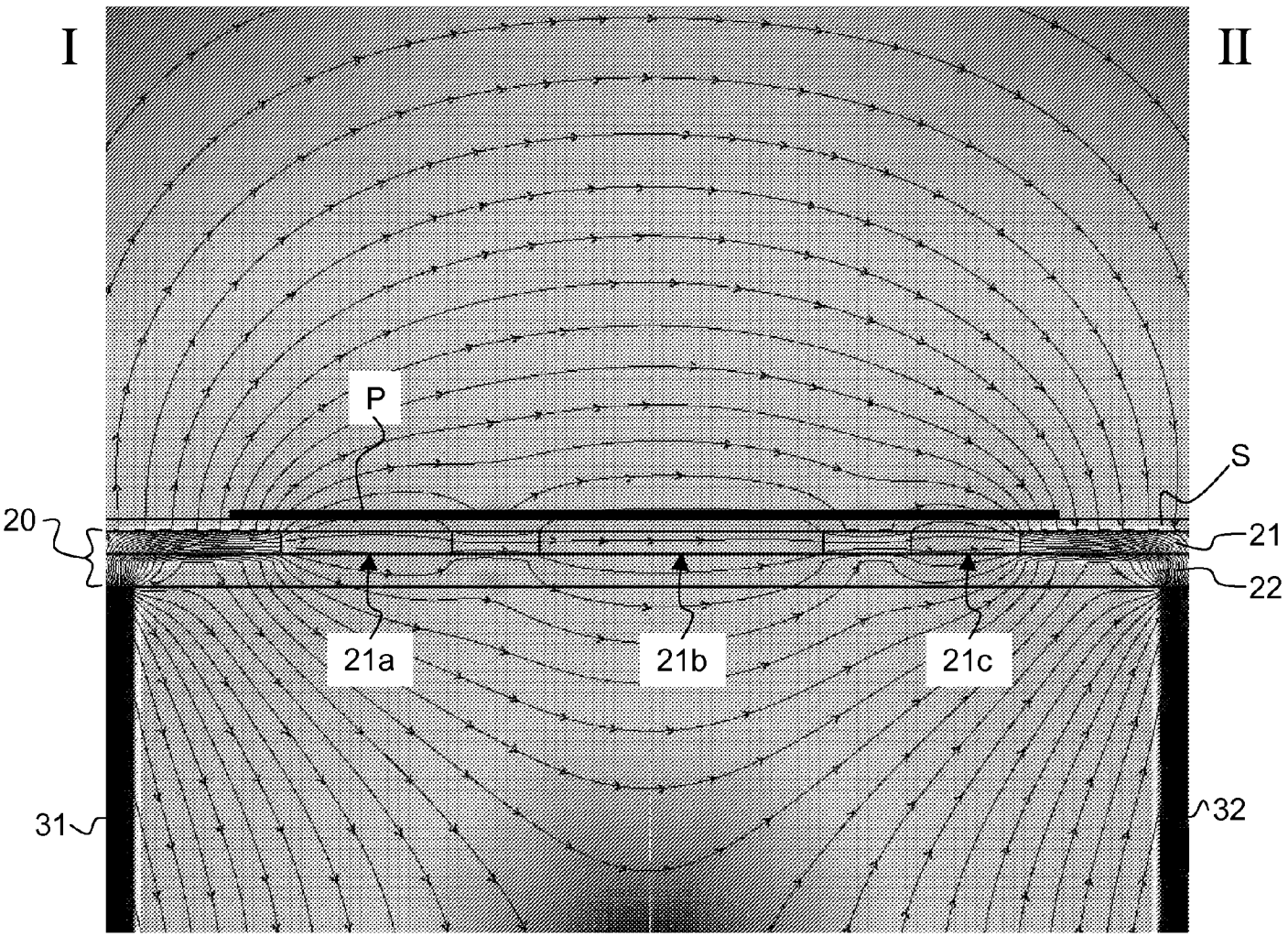
FIG. 4 is a magnetic field simulation of the magnetic-field-generating device of FIG. 3.

A simulation of the resulting magnetic field distribution is shown schematically in FIG. 4. This simulation was produced using the publicly available modelling software Vizimag (http://www.vizimag.com/) and considering a nickel layer as layer 21 and a copper base plate as base plate 22.

In the absence of any engravings in layer 21, the magnetic field lines would mostly be concentrated in the layer 21 itself, this layer 21 acting as a magnetic short-circuit. The engravings 21*a*, 21*b*, 21*c* in the layer 21, which form in essence regions of low magnetic permeability (i.e. free space), force the magnetic field lines along different routes and orientations. In other words, the engravings 21*a*, 21*b*, 21*c* influence the orientation of the field lines of the magnetic field in the vicinity of the engravings 21*a*, 21*b*, 21*c*.

Figure 1:
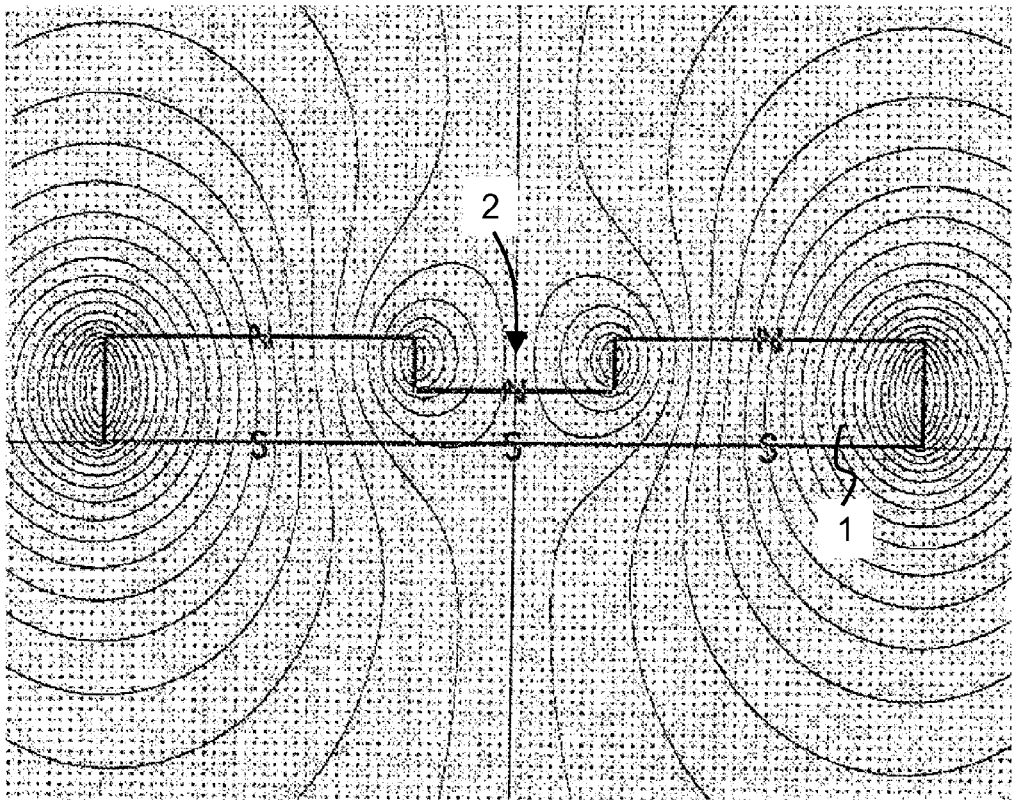
Fig. 1 (PRIOR ART)
FIG. 1 is a schematic cross-sectional view of a magnetic field simulation taken from International application WO 2005/002866 mentioned hereinabove, which illustrates an example of a vertically-magnetized permanent magnetic plate comprising a rectangular engraving.

As illustrated schematically in FIG. 4, and in contrast to the prior solution disclosed in International application WO 2005/002866 (compare also FIG. 4 and FIG. 1), in the unengraved regions of the layer 21 of material of high magnetic permeability, the magnetic field lines are mostly concentrated inside the layer 21 and extend substantially parallel to the surface of the body 20. On the other hand, due to the presence of the engravings 21*a*, 21*b*, 21*c*, the magnetic field lines are forced outside the layer 21 and extend, in the regions of the sheet S and of the coating composition P directly above the engravings 21*a*, 21*b*, 21*c*, substantially horizontally rather than vertically as shown in the simulation of FIG. 1. Conversely, in the regions of the sheet S and of the coating composition P which are not directly above the engravings 21*a*, 21*b*, 21*c* (i.e. above the unengraved regions of layer 21), the field lines of the magnetic field tend to be oriented mostly vertically. Consequently, a major part of the particles in the coating composition P above the indicia-forming engravings 21*a*, 21*b*, 21*c* will be aligned almost horizontally, yielding a generally more reflective pattern.

Figure 2A:
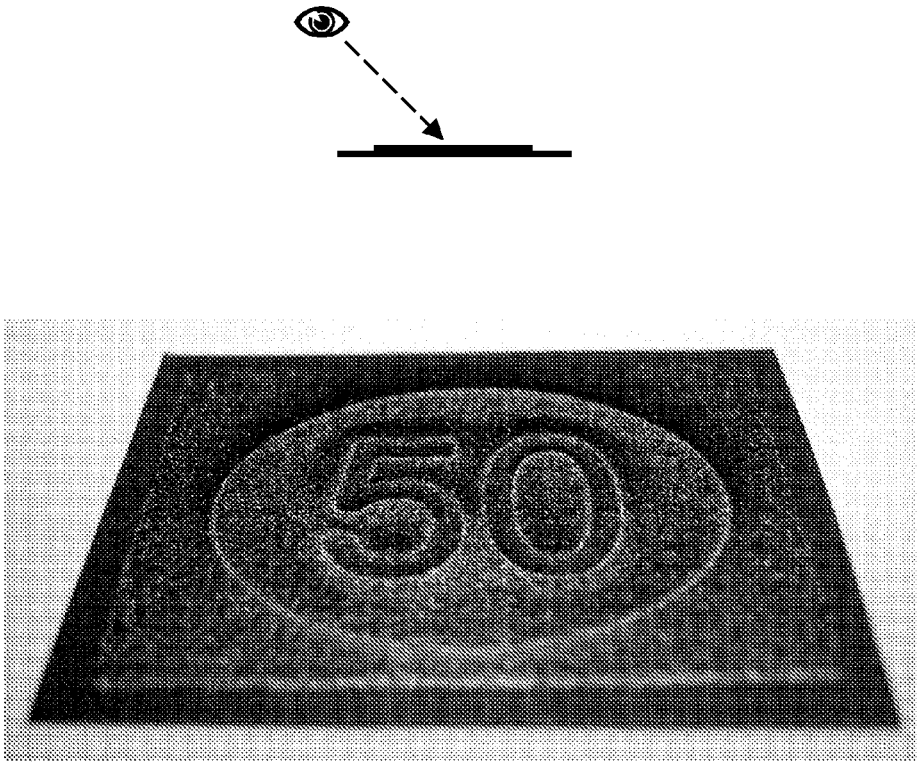
Fig. 2a (PRIOR ART)
FIGS. 2*a* to 2*c* are three greyscale photographs taken along three different viewing angles of an example of magnetically-induced pattern produced according to the known principle disclosed in WO 2005/002866.
Figure 2B:
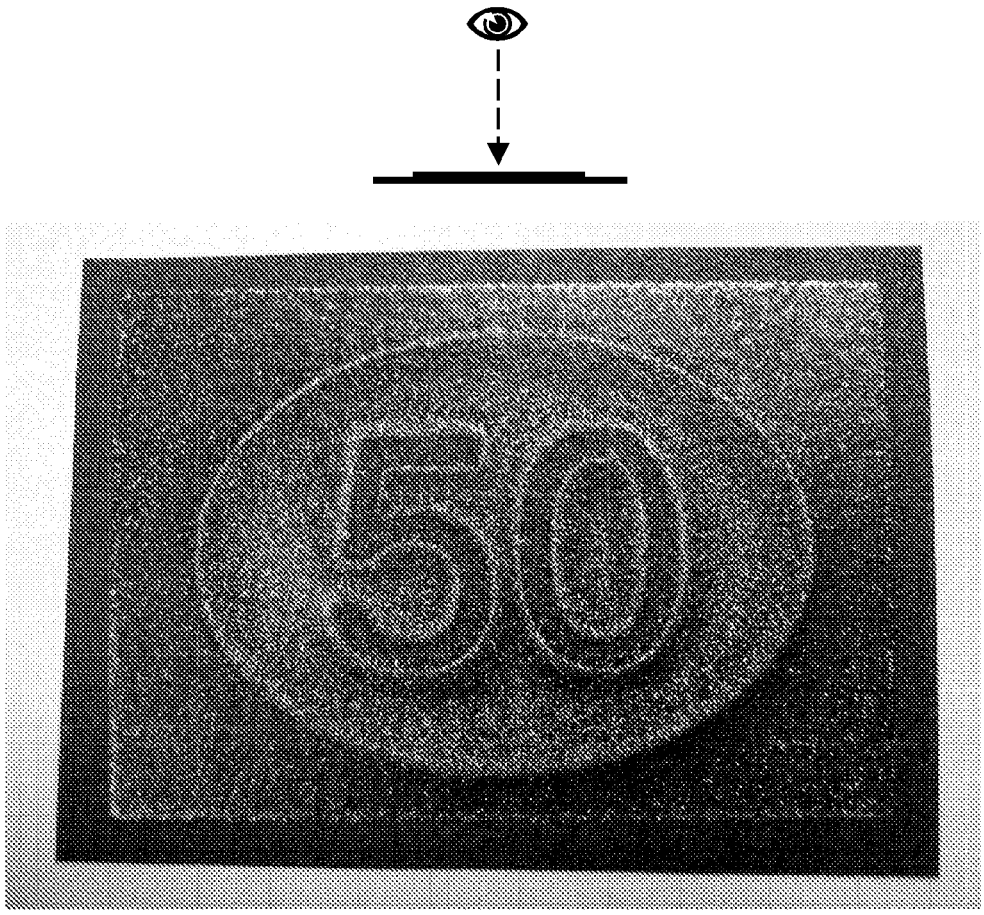
Fig. 2b (PRIOR ART)
Figure 2C:
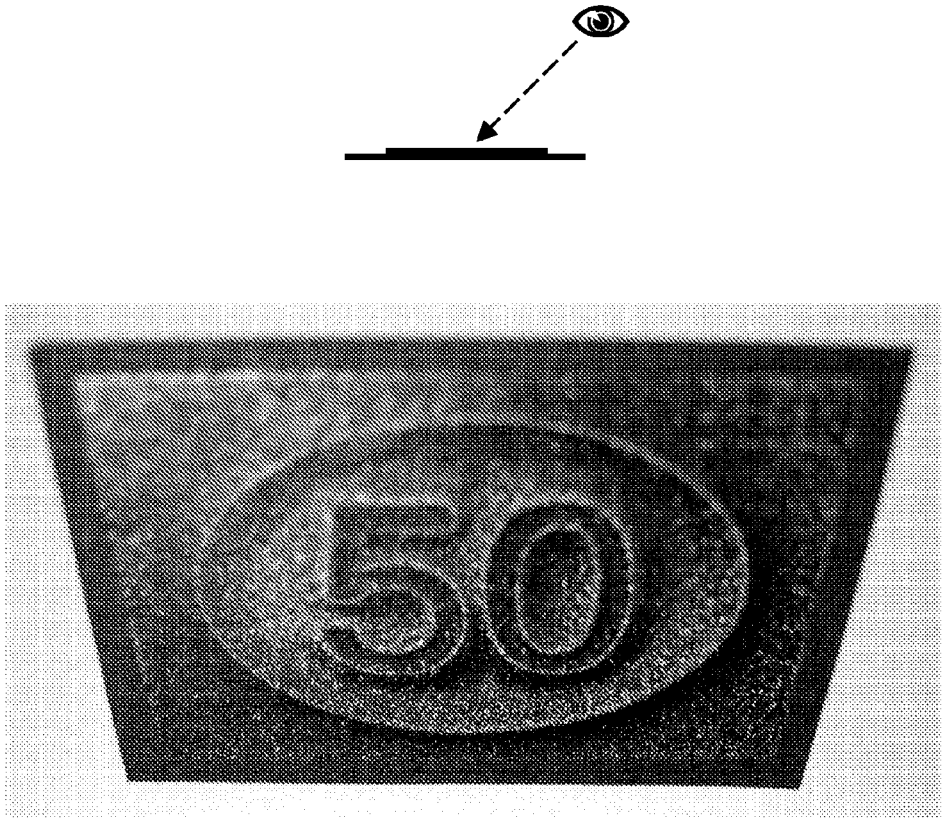
Fig. 2c (PRIOR ART)

This difference is clearly demonstrated by FIGS. 5*a* to 5*d* which are greyscale photographs taken from four different viewing angles of a magnetically induced pattern representing the value "50" within an oval shape, similar to the prior pattern illustrated in FIGS. 2*a* to 2*c*, but which was produced by means of a device according to the above-discussed preferred embodiment of the present invention.

More precisely, as far as the engravings are concerned, the body of the magnetic-field-generating device was engraved with exactly the same engraving pattern representing value "50" within an oval shape as that used for producing the prior pattern of FIGS. 2*a* to 2*c*. Rather than using the vertically-magnetized Plastoferrite plate as proposed in WO 2005/002866, the above mentioned copper-nickel (Cu—Ni) body 20 was used. In the context of this example, one will in particular understand that the engravings in the layer of material of high magnetic permeability are basically formed of an oval-shaped engraving inside which there remains an unengraved pattern representing the value "50".

As illustrated in FIGS. 5*a* to 5*d*, the resulting pattern is substantially more reflective and exhibits a radically different optical effect as compared to that illustrated in FIGS. 2*a* to 2*c*. Indeed, the optical effect created according to the invention is more or less inverted as compared to the optical effect illustrated in FIGS. 2*a* to 2*c*. More precisely, as illustrated in FIGS. 5*a* to 5*d*, the oval shape appears to stand out in relief above the background, like a solid volume, with the value "50" looking like having been engraved into the solid oval shape.

Figure 5A:
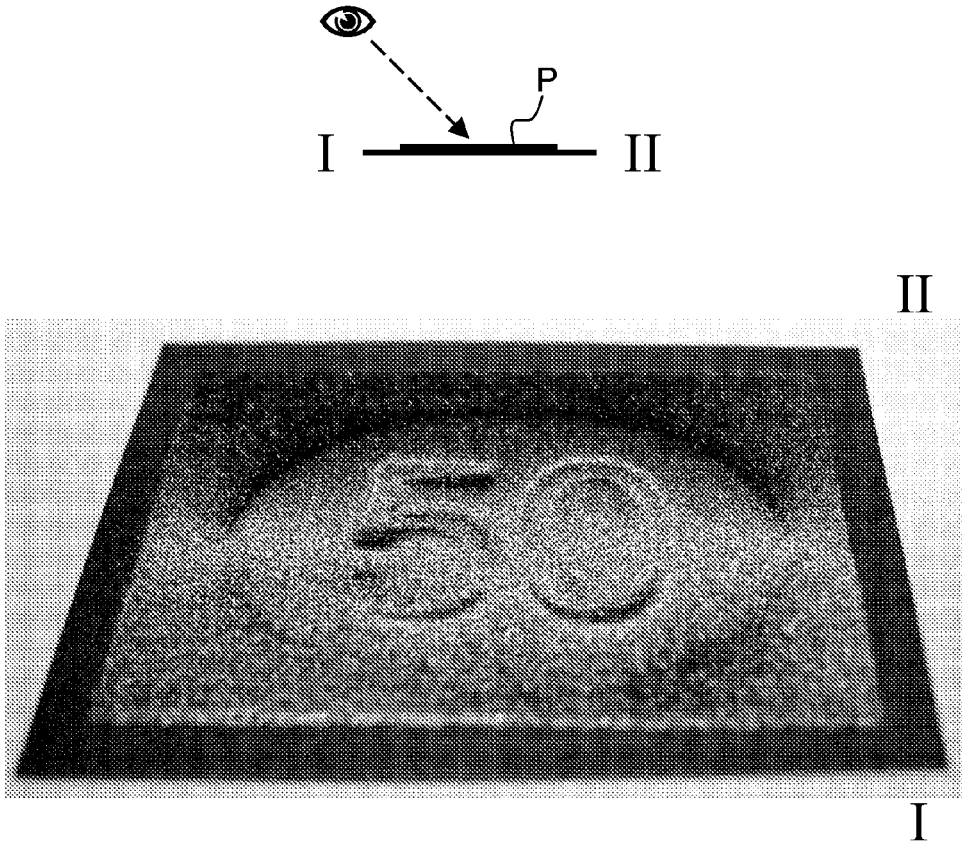
FIGS. 5*a* to 5*d* are four greyscale photographs taken along four different viewing angles of an example of magnetically-induced pattern produced according to the invention.
Figure 5B:
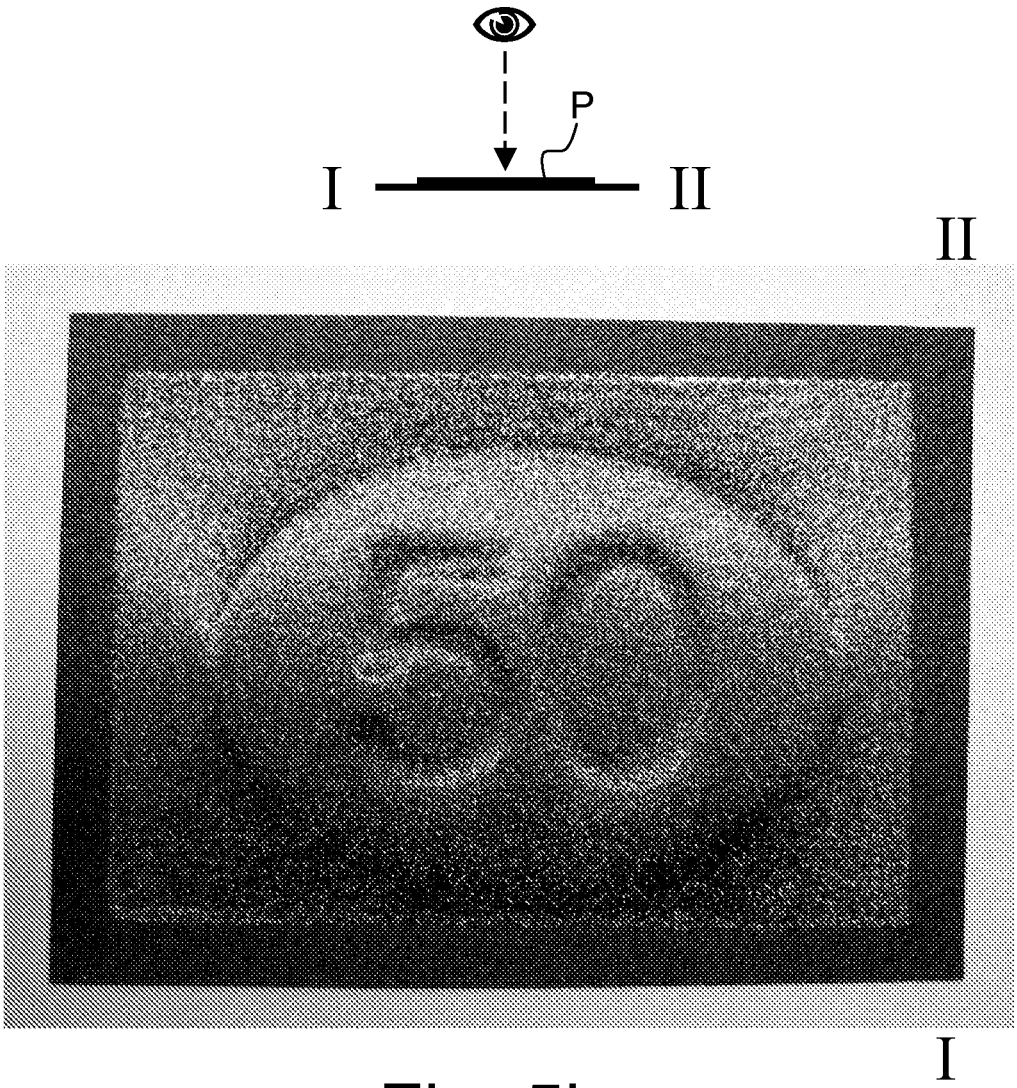
Figure 5C:
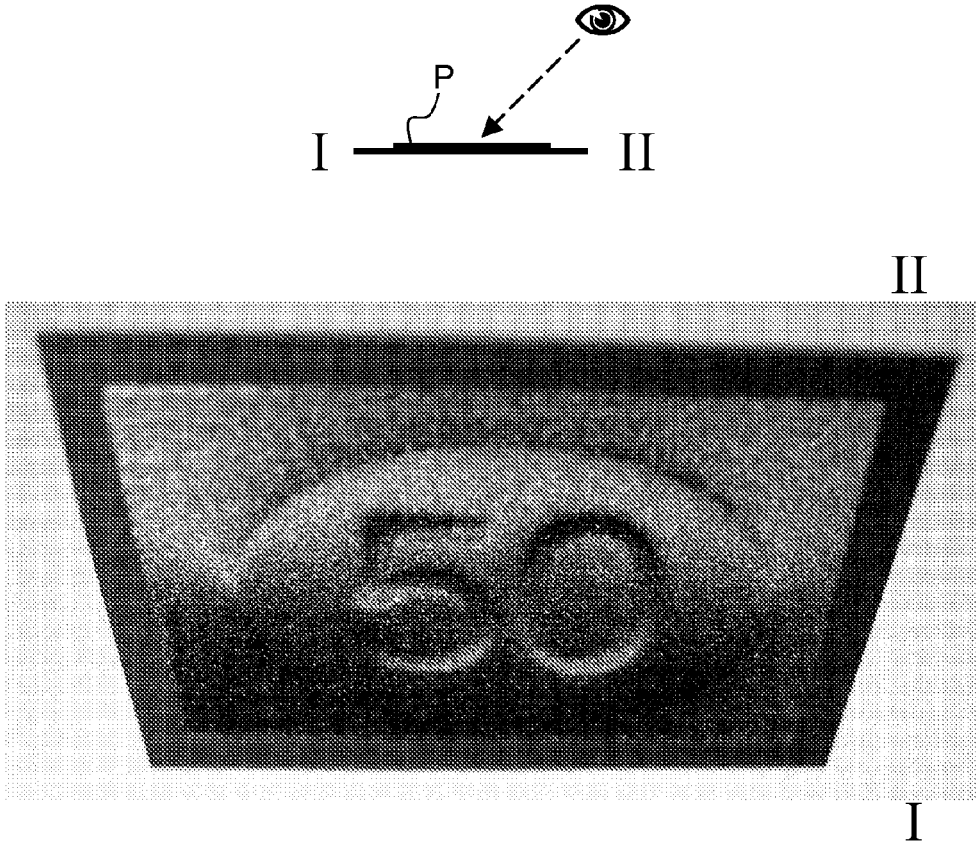
Figure 5D:
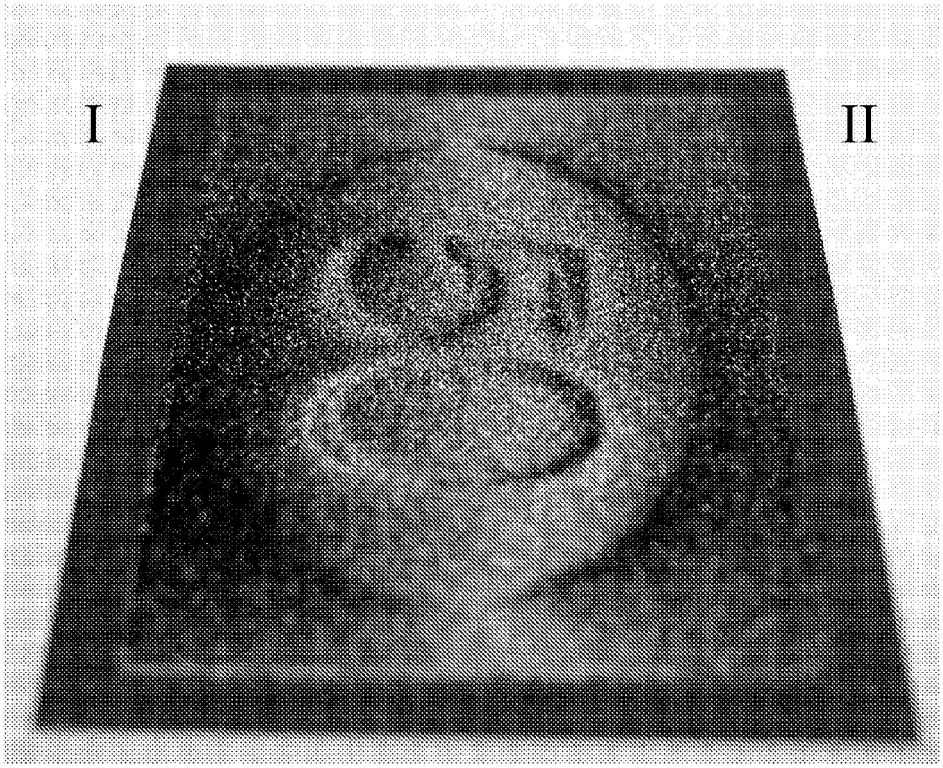
Figure 5E:
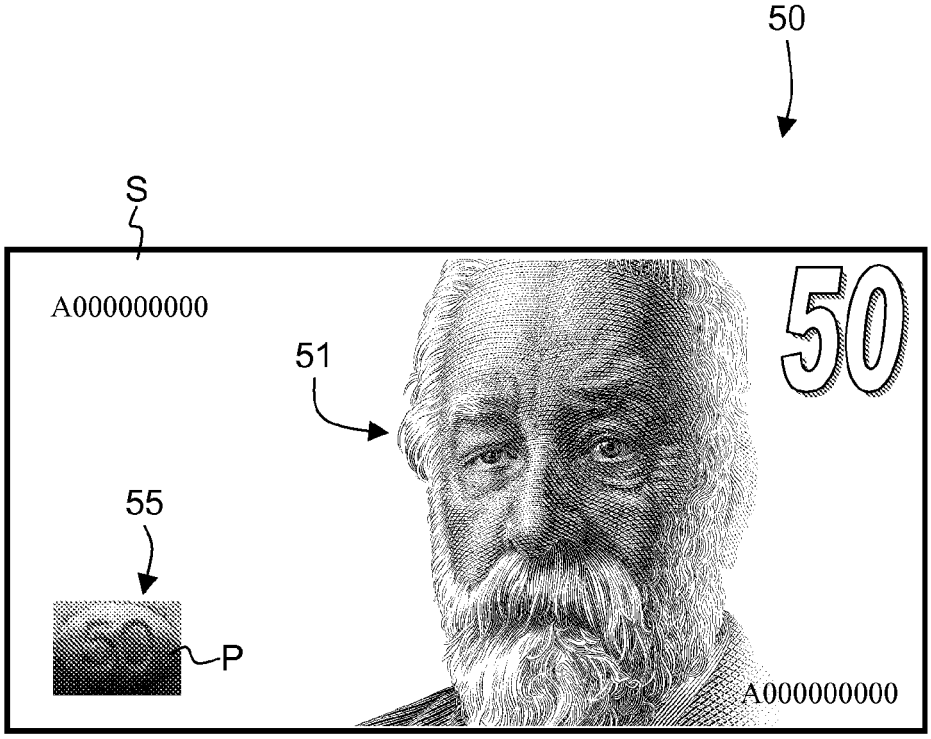
FIG. 5*e* is a schematic illustration of a banknote comprising a magnetically-induced pattern as illustrated in FIGS. 5*a* to 5*d;*
Figure 6A:
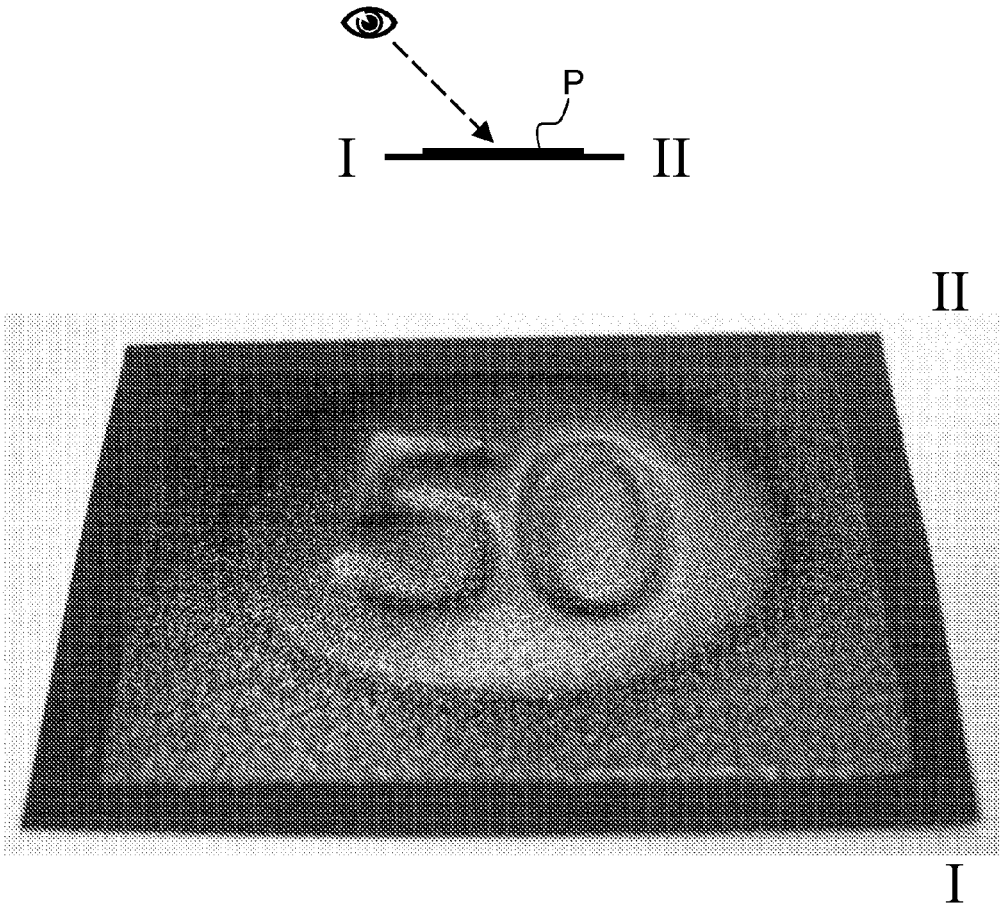
FIGS. 6*a* to 6*d* are four greyscale photographs taken along four different viewing angles of an example of magnetically-induced pattern, similar to that shown in FIGS. 5*a* to 5*c* produced according to a variant of the invention.
Figure 6B:
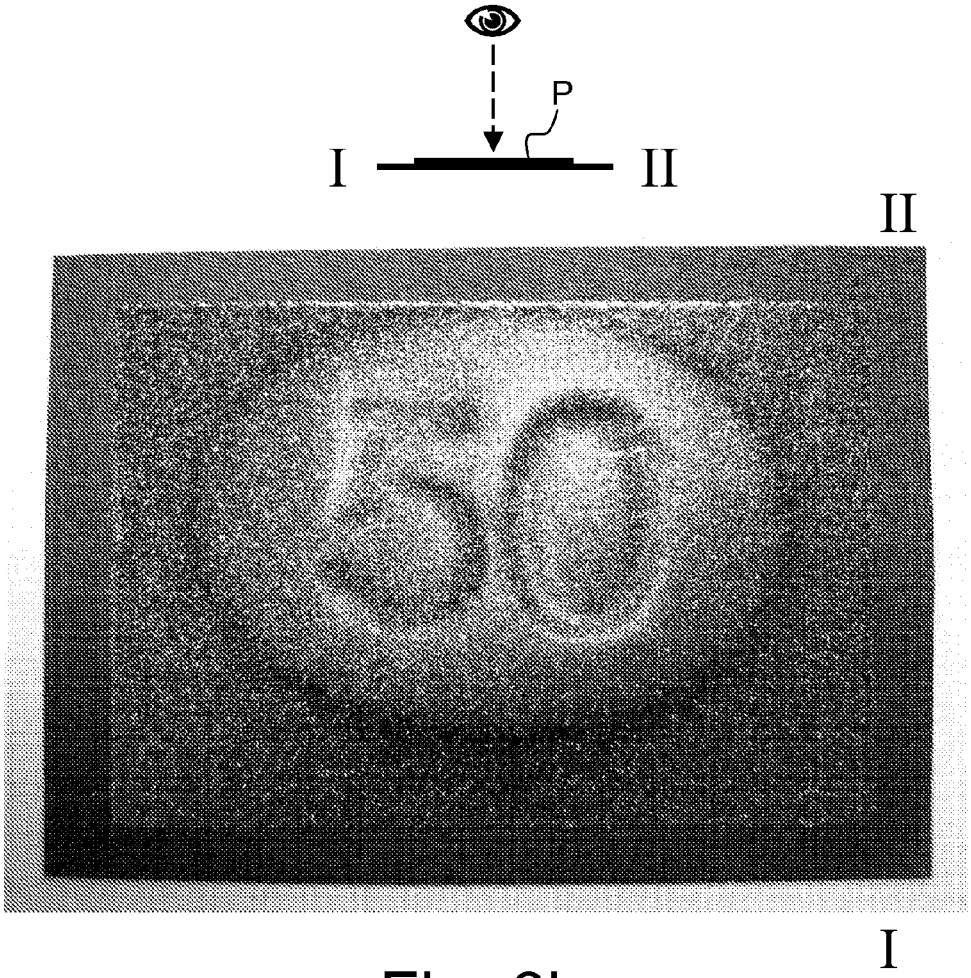
Figure 6C:
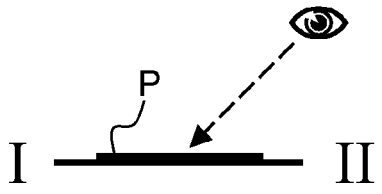
Figure 6C:
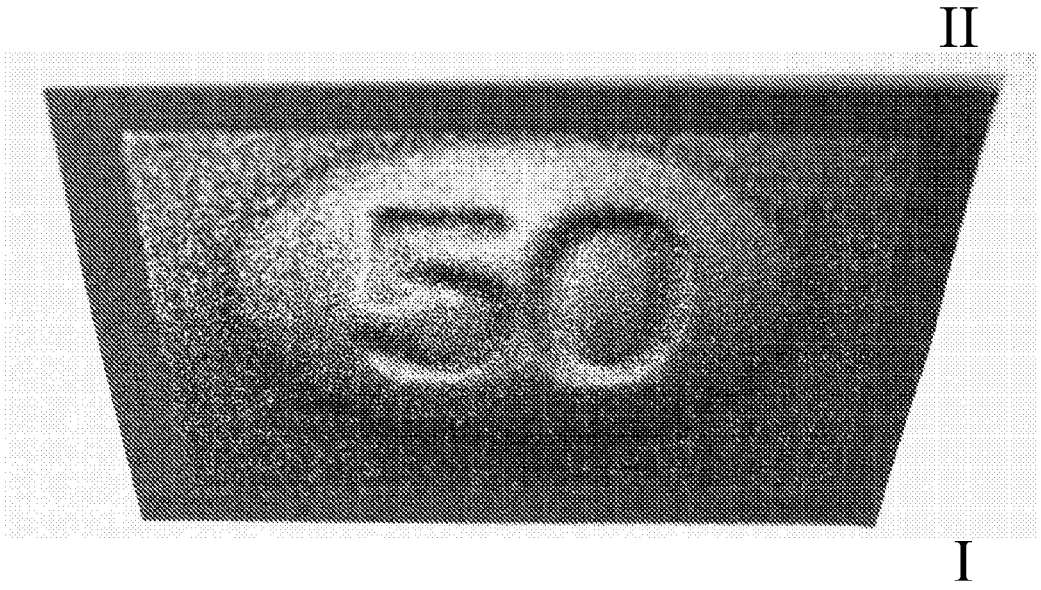
Figure 6D:
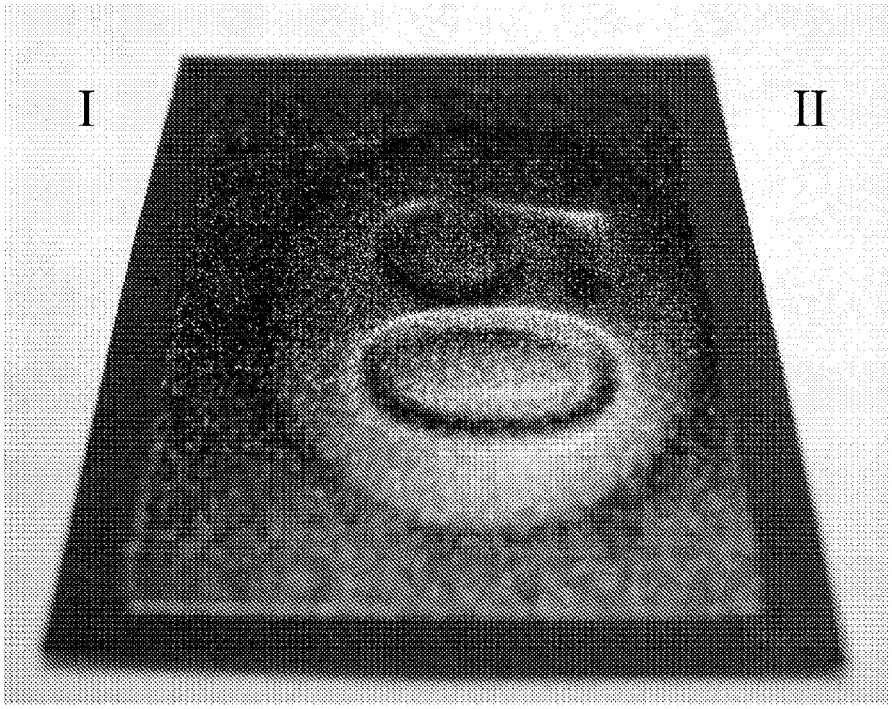

FIG. 5*e* is a schematic illustration of a possible banknote 50 comprising inter alia a portrait 51 and a magnetically-induced pattern 55 produced according to the present invention, such as the pattern of FIGS. 5*a* to 5*d*.

While performing tests using the above-described magnetic-field-generating device 10, it has become apparent that the orientation of the engraved patterns on the body 20 had some importance on the resulting effect. Indeed, in the embodiment of the magnetic-field-generating device 10 illustrated in FIGS. 3 and 4, the magnetic field lines, seen perpendicular to the surface of the body 20, are generally oriented along one main direction, that is along the direction I-II in FIGS. 3 and 4. The "main direction" is understood here as referring to the general direction of the field lines of the magnetic field, that is from left to right in FIGS. 3 and 4 (this "main direction" extends from bottom to top in the greyscale photographic illustrations of FIGS. 5*a* to 5*c* and from left to right in the greyscale photographic illustration of FIG. 5*d*). Accordingly, portions of the borders of the engravings in the layer of material of high magnetic permeability which are oriented substantially parallel to this main direction I-II will not as such have much influence on the orientation of the magnetic field lines and the corresponding parts of the magnetically induced pattern in the coating composition P will have a tendency to disappear or be attenuated as a result. Looking for instance at the photographs of FIGS. 5*a* to 5*d*, one can in particular see that the side portions on the left-hand side and right-hand side of the oval shape are substantially attenuated.

In order to overcome this effect, one could design the engraved pattern so as to be devoid of engraved patterns having border portions extending along the main direction of the magnetic field lines and/or make the engraved pattern is such regions wide enough so as to cause a greater influence on the local orientation of the magnetic field lines.

Alternatively, a solution might consist in changing the main direction of the magnetic field lines during exposure of the layer of coating composition P. This is preferably carried out by changing, preferably by rotating, advantageously by 360°, the magnetic field with respect to the exposed layer of coating composition P. It shall be understood that the axis of rotation of the magnetic field is to be considered as being substantially perpendicular to the plane where the coating composition P is applied, i.e. substantially perpendicularly to the surface of the body 20 and of the sheet S. FIGS. 6*a* to 6*d* are greyscale photographs taken along the same four different viewing angles as in FIGS. 5*a* to 5*d* of a magnetically-induced pattern representing the value "50" within an oval shape, identical to that of FIGS. 5*a* to 5*d*, with the additional provision that, during exposure of the layer of coating composition P, the main direction of the magnetic field lines was rotated by 360°.

As a result of the rotation of the magnetic field during exposure of the coating composition P, the above-mentioned attenuation effect is decreased or completely avoided. This rotation moreover appears to strengthen the embossing/relief effect on the resulting magnetically-induced pattern by making it visible in substantially the same way from all viewing angles, in the manner of a hologram. The difference is in particular visible from a comparison of the photographs of FIGS. 5*d* and 6*d* which are both taken from the same viewing angle, namely from the left-hand side of the coating composition P.

FIGS. 7*a* to 7*d* are four photographs taken along the same four different viewing angles as those of FIGS. 5*a* to 5*d* and 6*a* to 6*d*, of another example of a magnetically-induced pattern. In this latter example, the main direction of the magnetic field was also rotated by 360° during exposure of the coating composition P.

Figure 7A:
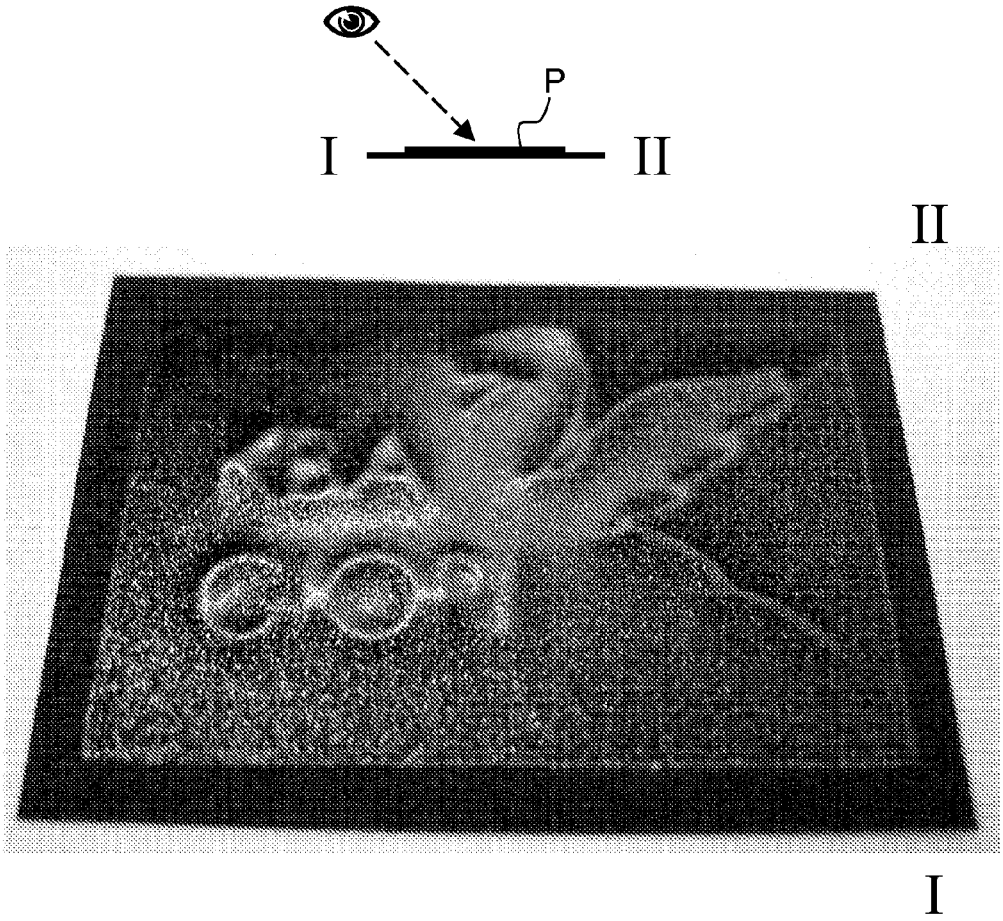
FIGS. 7*a* to 7*d* are four greyscale photographs taken along four different viewing angles of another example of magnetically-induced pattern produced according to the invention.
Figure 7B:
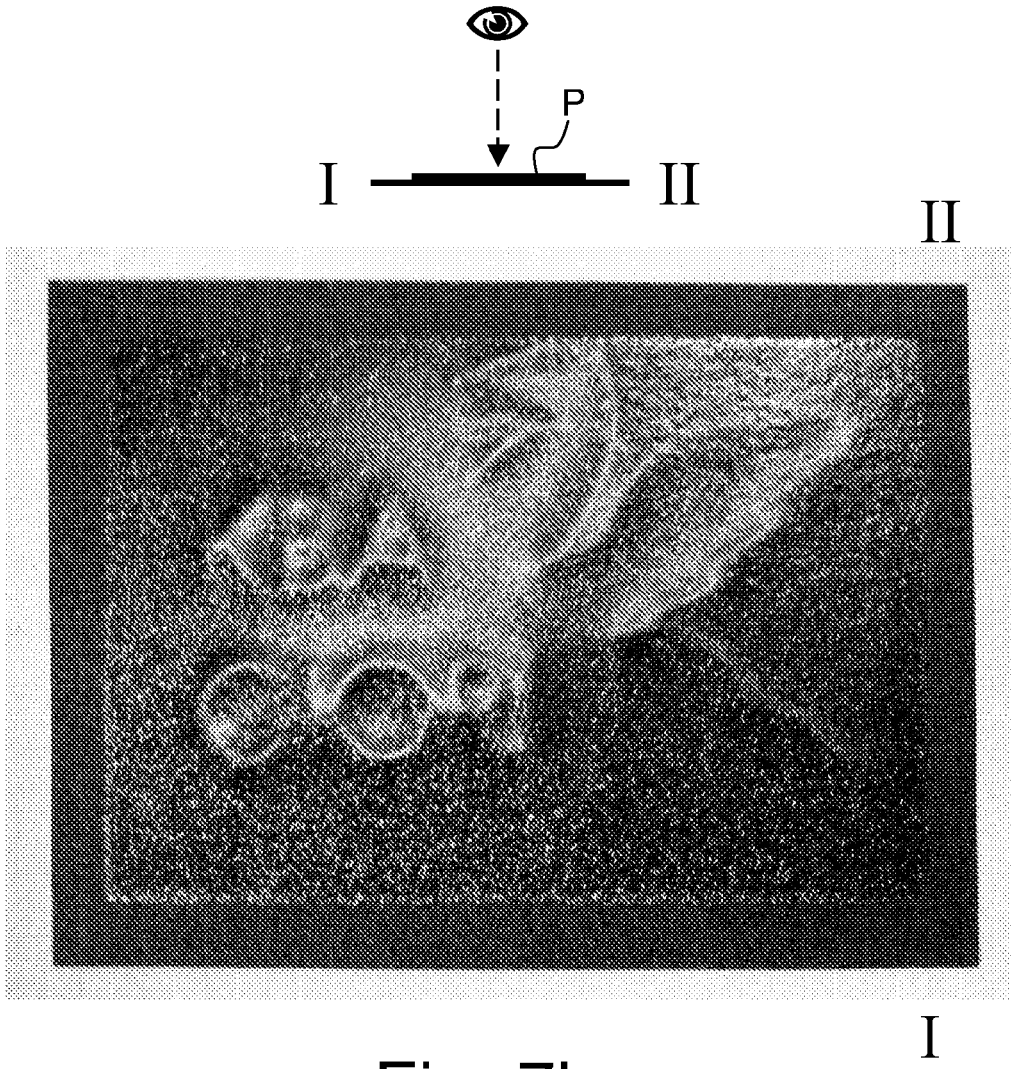
Figure 7C:
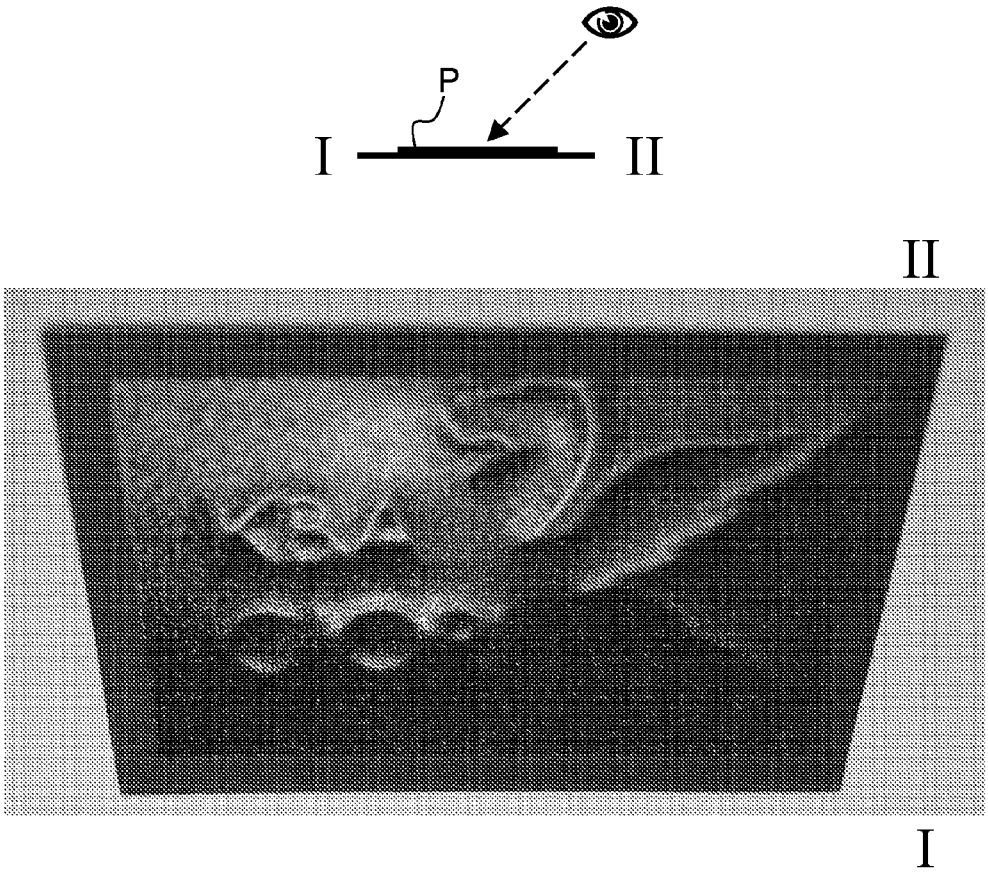
Figure 7D:
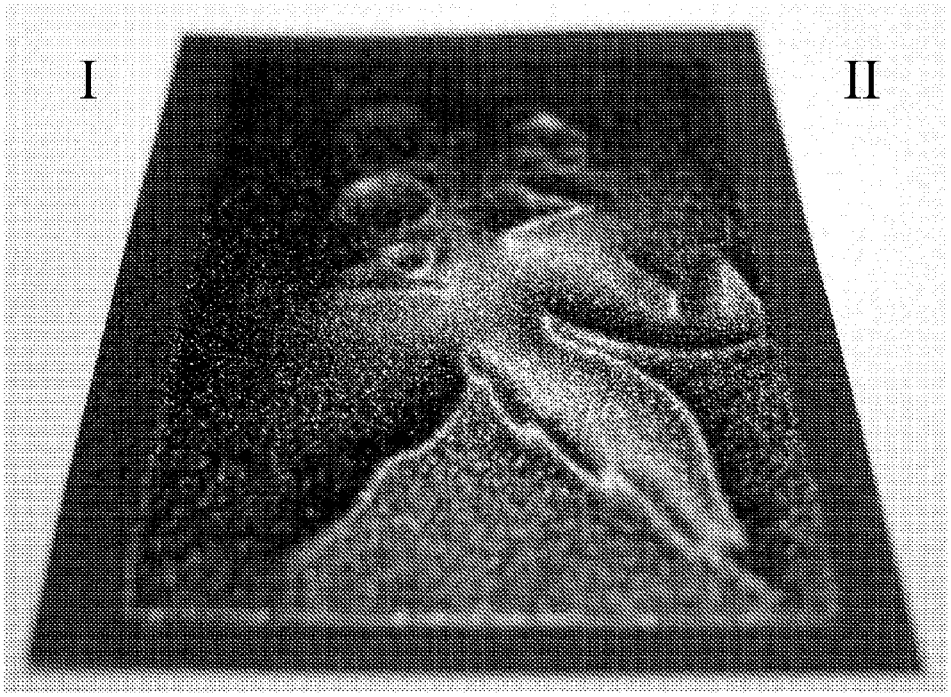
Figure 7E:
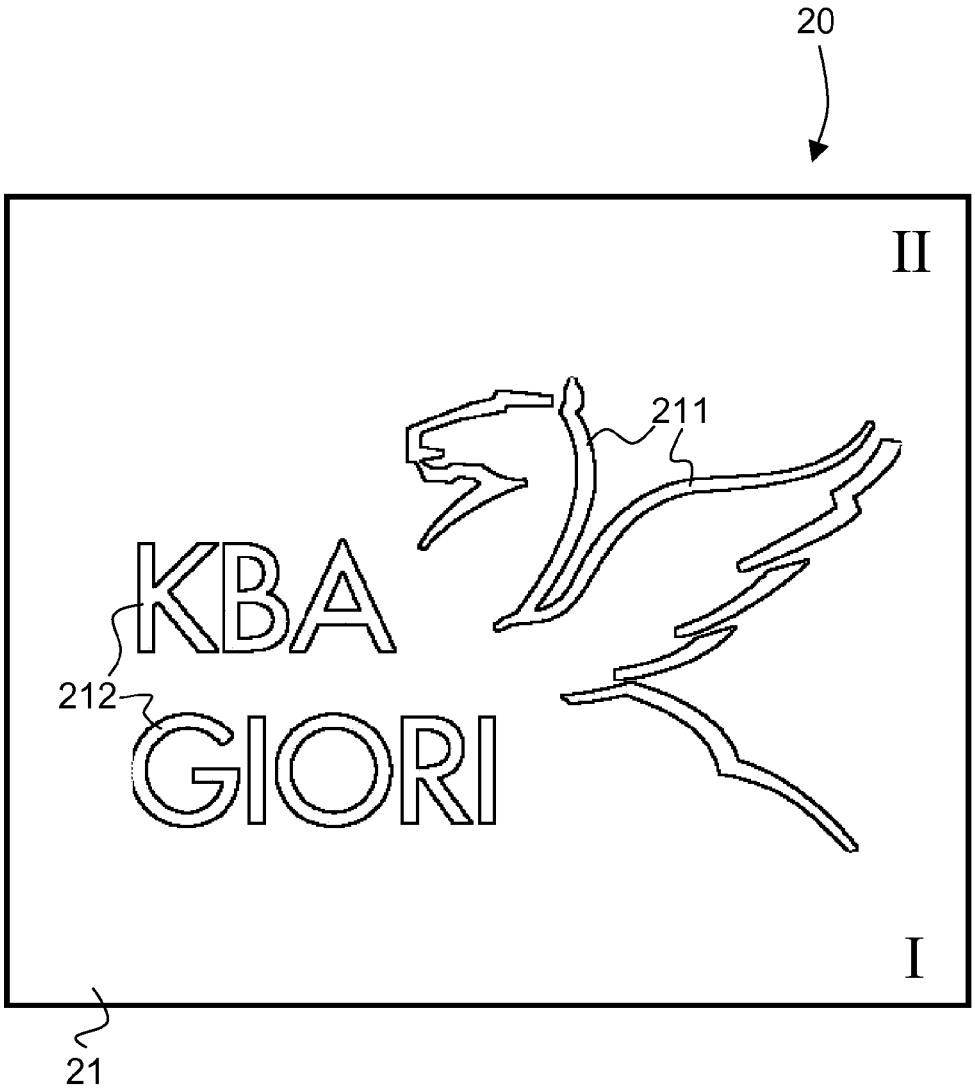
FIG. 7*e* is a schematic top view of the engraving pattern of the body used to produce the magnetically-induced pattern of FIGS. 7*a* to 7*d*.

FIG. 7*e* is a schematic top view of the engraved body 20 which was used in the context of the example shown in FIGS. 7*a* to 7*d*. As illustrated, the layer 21 of the body 20 was engraved with a pattern of engravings 211, 212 representing, on the one hand, a stylised representation of a Pegasus 211 and, on the other hand, the words "KBA GIORI" 212. In this example, the rectilinear or curvilinear patterns 211, 212 where engraved with a line width of approximately 1 millimeter. Tests have shown that a line width of 1 millimeter or more is preferable in the context of the present invention. Similarly, too dense an engraving pattern is preferably to be avoided, i.e. a line spacing of 1 millimeter or more between neighbouring engravings is to be preferred.

Preferably, the thickness of layer 21 should be selected to be greater or equal to 50 microns, even more preferably in the range of 50 to 500 microns. The thickness of the base plate 22 on the other hand is not critical.

The tests have shown that the distance between the permanent magnets 31, 32 and the body 20 had some influence on the resulting magnetically-induced pattern. Within the scope of the present invention, the permanent magnets (or, alternatively, the electromagnets) could be disposed at a distance from the body 20 (e.g. of the order of a few centimeters) or in close contact with the body 20 depending on the effect one wishes to produce. In that respect, the magnetic force of the magnets also plays a role.

As already mentioned, electromagnets could be used in lieu of permanent magnets to create the necessary magnetic field. Electromagnets are particularly advantageous in that the magnetic field can be completely suppressed at the end of the exposure, thereby preventing further modification of the orientation of the magnetic or magnetizable particles, especially during removal of the substrate from the surface of the body 20. In addition, rotation of the main direction of the magnetic field, as discussed above, can easily be carried out using electromagnets disposed in a circular arrangement and by electronically switching the orientation of the magnetic field in a manner similar to that performed in the context of the actuation of electric motors. Rotation of the magnetic field using permanent magnets would have to be performed by physical rotation of the permanent magnets themselves (or of the substrate S carrying the layer of coating composition P) during exposure.

The above-described invention can be implemented by designing the above-described magnetic-field-generating device 10 so as to be disposed on the circumference of a cylindrical body of a printing press as generally taught in International application No. WO 2005/000585 in the name of the present Applicant.

Figure 8:
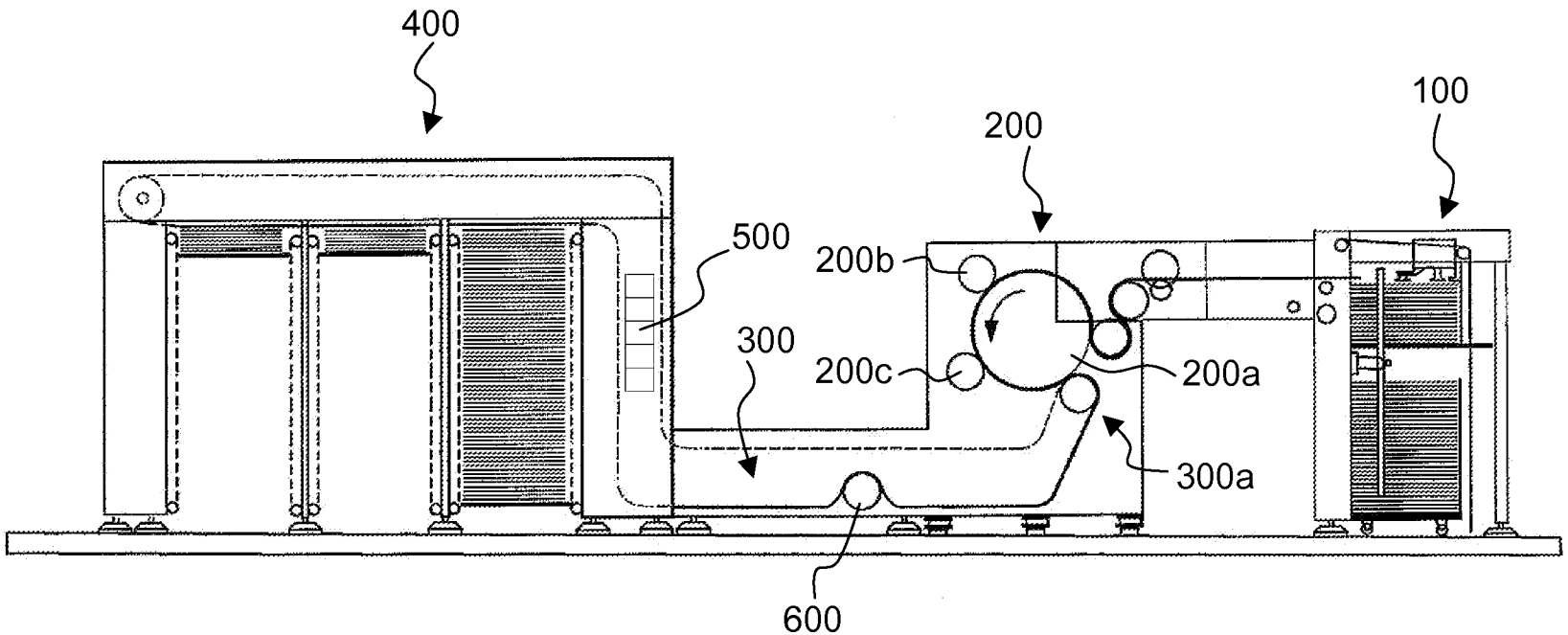
FIG. 8 is a schematic side view of a silk-screen printing press suitable for carrying out the invention.

FIG. 8 schematically illustrates one possible embodiment of a sheet-fed printing press as disclosed in International application No. WO 2005/000585, which application is incorporated herein by reference. This printing press is adapted to print sheets according to the silk-screen printing process and comprises a feeding station 100 for feeding successive sheets to a silk-screen printing group 200 where silk-screen patterns are applied onto the sheets. In this example the printing group 200 comprises an impression cylinder 200*a* cooperating with two screen cylinders 200*b*, 200*c* placed in succession along the printing path of the sheets. Once processed in the printing group 200, the freshly printed sheets are transported by means of a conveyor system 300 to a delivery station 400 comprising a plurality of delivery pile units, three in this example. The conveyor system 300 is typically an endless chain conveyor system comprising a plurality of spaced-apart gripper bars (not shown in FIG. 8) extending transversely to the sheet transporting direction, each gripper bar comprising clamping means for holding a leading edge of the sheets.

In the example illustrated in FIG. 8, a cylinder body 600 carrying a plurality of magnetic-field-generating devices is located along the path of the sheets carried by the chain conveyor system 300. This cylinder body 600 is designed to apply a magnetic field to selected locations of the sheets for the purpose of orienting magnetic flakes contained in the patterns of coating composition which have been freshly-applied on the sheets in the printing group 200, as discussed above. A drying or curing unit 500 is provided downstream of the cylinder body 600 for drying, respectively curing, the coating composition applied onto the sheets after the magnetic flakes have been oriented and prior to the delivery in the delivery station 400, such unit 500 being typically an infrared drying unit or a UV curing unit depending on the type of coating composition used (e.g. water-based or UV-cured inks/varnishes).

Further details regarding silk-screen printing presses, including relevant details of the silk-screen printing press illustrated in FIG. 8, can be found in European patent applications EP 0 723 864, EP 0 769 376 and in International applications WO 97/29912, WO 97/34767, WO 03/093013, WO 2004/096545, WO 2005/095109 and WO 2005/102699.

As discussed in International application No. WO 2005/000585, the cylinder body 600 could alternatively be located at the sheet transfer location 300*a* between the impression cylinder 200*a* and the conveyor system 300. Still according to another embodiment envisaged in International application No. WO 2005/000585, the impression cylinder 200*a* itself could be designed as a cylinder carrying magnetic-field-generating devices.

In the embodiment illustrated in FIG. 8, the cylinder body 600 used to orient the magnetic flakes advantageously cooperates with the non-freshly-printed side of the sheets, thereby preventing smearing problems, the magnetic field being applied from the back side of the sheets through the freshly-printed patterns of coating composition. During orientation of the magnetic flakes, i.e. at the time when a sheet carried by the conveyor system 300 contacts the upper part of the circumference of the cylinder body 600, the cylinder body 600 is rotated at a circumferential speed corresponding to the speed of the transported sheets so that there is no relative displacement between the transported sheets and the circumference of the cylinder. As illustrated, the cylinder body 600 is placed in the path of the chain conveyor system 300 such that the sheets follow a curved path tangential to the outer circumference of the cylinder body 600, thereby enabling part of the surface of the processed sheet to be brought in contact with the outer circumference of the cylinder body 600.

In the context of the production of banknotes, in particular, each printed sheet (or each successive portion of a continuous web, in case of web-printing) carries an array of imprints arranged in a matrix of rows and columns, which imprints ultimately form individual securities after final cutting of the sheets or web portions. The cylinder body 600 used to orient the magnetic flakes is therefore typically provided with as many magnetic-field-generating devices as there are imprints on the sheets or web portions.

The cylinder body 600 is preferably a cylinder body as further taught in European patent application No. 07102749.4 entitled "CYLINDER BODY FOR ORIENTING MAGNETIC FLAKES CONTAINED IN AN INK OR VARNISH VEHICLE PRINTED ON A SHEET-LIKE OR WEB-LIKE SUBSTRATE", filed on Feb. 20, 2007 in the name of the present Applicant. According to this patent application, the cylinder body advantageously comprises a plurality of distinct annular supporting rings distributed axially along a common shaft member, each annular supporting ring carrying a set of magnetic-field-generating devices which are distributed circumferentially on an outer circumference of the annular supporting rings. Thanks to this cylinder body configuration, the position of each magnetic-field-generating device can be adjusted to the corresponding position of the coating composition imprints on the processed sheets or web.

Turning back to the magnetic-field-generating devices according to the present invention, it will be appreciated that the body 20 can be shaped as a curved plate adapted for mounting onto a rotatable cylinder body of a printing press (in such a case, a common plate with engravings could be used for all magnetic-field-generating devices) or, alternatively, as an individual curved plate element adapted for mounting onto a supporting member disposed on the circumference of a cylindrical body of a printing press (in such a case, individual plates would be used).

Various modifications and/or improvements may be made to the above-described embodiments without departing from the scope of the invention as defined by the annexed claims.

For instance, while silk-screen printing is a preferred printing process for applying the coating composition comprising the magnetic or magnetizable particles to be oriented, other printing process might be envisaged, such as flexographic printing, gravure printing, or even intaglio printing as discussed in European patent application EP 1 650 042.

In addition, while the layer of coating composition P is preferably to be printed on a dark background, any other background is possible such as for example a structured background as discussed in International application WO 2006/061301. A mainly dark background is however preferred in order to yield a better contrast in the resulting magnetically-induced pattern.

The invention claimed is:

1. A device for magnetically transferring indicia to a layer of coating composition applied to at least a part of a surface of a substrate, said coating composition comprising at least one type of magnetic or magnetizable particles, said device comprising electromagnetic means for generating a magnetic field and a body subjected to the magnetic field generated by the electromagnetic means, which body carries determined indicia in the form of engravings on a surface of the body, which engravings influence orientation of field lines of the magnetic field, wherein said body comprises at least one layer of material of high magnetic permeability in which said engravings are formed and wherein, in unengraved regions of said layer of material of high magnetic permeability, the field lines of the magnetic field extend substantially parallel to the surface of said body inside said layer of material of high magnetic permeability, and wherein said body further comprises a base plate of material of low magnetic permeability supporting said layer of material of high magnetic permeability.

2. The device according to claim 1, wherein said layer of material of high magnetic permeability is deposited on said base plate by galvanization.

3. The device according to claim 1, wherein the magnetic permeability of said base plate is in the range of 1.25 to 1.26 $\mu N/A^2$.

4. The device according to claim 3, wherein said base plate is made of a non-ferromagnetic material.

5. The device according to claim 1, wherein the engravings in said layer of material of high magnetic permeability extend through the whole thickness of said layer.

6. The device according to claim 1, wherein the magnetic permeability of said layer of material of high magnetic permeability is greater than 100 $\mu N/A^2$ (@ 0.002 T).

7. The device according to claim 6, wherein said layer of material of high magnetic permeability is made of a ferromagnetic material.

8. The device according to claim 1, wherein said layer of material of high magnetic permeability exhibits a thickness greater or equal to 50 microns.

9. The device according to claim 1, wherein said engravings comprise engraved rectilinear or curvilinear patterns.

10. The device according to claim 1, wherein the electromagnetic means comprise at least one permanent magnet for generating said magnetic field.

11. The device according to claim 1, wherein the electromagnetic means comprise at least one electromagnet for generating said magnetic field.

12. The device according to claim 1, wherein the field lines of said magnetic field, seen perpendicular to the surface of the body, extend along substantially one main direction.

13. The device according to claim 1, wherein said body is shaped as a curved plate adapted for mounting onto a rotatable cylinder body of a printing press.

14. The device according to claim 1, wherein said body is shaped as an individual curved plate element adapted for mounting onto a supporting member disposed on the circumference of a cylindrical body of a printing press.

15. The device according to claim 4, wherein the non-ferromagnetic material consists of copper, aluminium or alloys thereof.

16. The device according to claim 6, wherein the magnetic permeability of the layer of material of high magnetic permeability is between 100 to 1000 $\mu N/A^2$ (@ 0.002 T).

17. The device according to claim 7, wherein the ferromagnetic material consists of iron, nickel, cobalt or alloys thereof.

18. The device according to claim 8, wherein the thickness of the layer of material of high magnetic permeability is between 50 to 500 microns.

19. The device according to claim 9, wherein the engraved rectilinear or curvilinear patterns have a line width and/or a line spacing of 1 millimeter or more.

20. A method for magnetically transferring indicia onto a substrate, comprising the steps of :

(a) applying a layer of a coating composition onto at least a part of the surface of the substrate, said coating composition comprising at least one type of magnetic or magnetizable particles;

(b) while the layer of coating composition is still wet, exposing the layer of coating composition to a determined magnetic field generated at a surface of a device according to any one of the preceding claims, thereby orienting the magnetic or magnetizable particles along field lines of said magnetic field; and (c) drying or curing the layer of coating composition, thereby fixing the orientation of said magnetic or magnetizable particles.

21. The method according to claim 20, wherein the field lines of said magnetic field, seen perpendicular to the surface of the body, extend along substantially one main direction and wherein said main direction of the field lines of the magnetic field is changed during exposure of the layer of coating composition at step (b).

22. The method according to claim 20, wherein said coating composition is applied by printing.

23. The method according to claim 20, wherein the coating composition is an ink or a varnish.

24. The method according to claim 21, wherein the main direction of the field lines of the magnetic field is rotated by 360° during exposure of the layer of coating composition at step (b).

25. The method according to claim 22, wherein the coating composition is applied by silk-screen printing, flexographic printing or gravure printing.

* * * * *